United States Patent [19]

Atkey

[11] 4,201,053

[45] May 6, 1980

[54] TELESCOPIC CYLINDER AUTOMATIC SYNCHRONIZER

[75] Inventor: Richard E. Atkey, Memphis, Tenn.

[73] Assignee: Dover Corporation, Memphis, Tenn.

[21] Appl. No.: 957,832

[22] Filed: Nov. 6, 1978

[51] Int. Cl.[2] ..... F15B 15/16

[52] U.S. Cl. ..... 60/459; 60/464; 60/486; 91/168; 92/152

[58] Field of Search ..... 60/420, 459, 464, 486, 60/369, 378; 91/168; 92/152

[56] References Cited

U.S. PATENT DOCUMENTS

| | | | |
|---|---|---|---|
| 165,472 | 7/1875 | Brinckerhoff | 91/168 |
| 172,896 | 2/1876 | Stebins | 91/168 |
| 1,853,147 | 4/1932 | Reynolds | 60/589 |
| 4,043,428 | 8/1977 | White et al. | 187/17 |

FOREIGN PATENT DOCUMENTS

| | | |
|---|---|---|
| 727962 | 2/1966 | Canada . |
| 1240743 | 3/1967 | Fed. Rep. of Germany . |
| 877869 | 9/1961 | United Kingdom . |
| 1421096 | 1/1976 | United Kingdom . |

*Primary Examiner*—Edgar W. Geoghegan
*Attorney, Agent, or Firm*—Brumbaugh, Graves, Donohue & Raymond

[57] ABSTRACT

A telescoping hydraulic cylinder apparatus for elevator application, wherein telescoping cylinders and a piston rod extend or retract simultaneously, having a compensator pump for automatically replenishing fluid lost due to leakage from the upper cylinders of the apparatus.

6 Claims, 4 Drawing Figures

TELESCOPIC CYLINDER AUTOMATIC SYNCHRONIZER

BACKGROUND OF THE INVENTION

This invention relates to improvements in hydraulic apparatus having telescopic cylinders for reaching comparatively long distances relative to the length of the cylinders. Telescoping cylinder apparatus are especially useful in elevator installations. Elevators of the hydraulic type usually have the capacity to extend upwardly a considerably greater distance than the length of any one hydraulic cylinder. This is accomplished by using a telescopic hydraulic cylinder apparatus including a base cylinder, one or more intermediate cylinders, and a piston rod, all of which extend outwardly from the upper end of the base cylinder, each successively smaller and telescopically arranged within the next larger cylinder.

An example of an apparatus of this type is contained in Canadian Pat. No. 727,962 to Richard E. Atkey, which shows and describes a telescopic hydraulic cylinder apparatus designed so that all the moving cylinders and the piston rod move simultaneously outwardly and inwardly relative to the respective cylinders in which they operate. This type of device obviated many of the disadvantages of prior art telescoping hydraulic devices inasmuch as simultaneous movement resulted in a constant speed during operation. In many prior forms of telescopic hydraulic cylinder apparatus, the individual hydraulic cylinders would operate successively rather than concurrently, resulting in jerking movements and changes in speed as each cylinder reached the end of its stroke. This rendered such devices unsuitable for elevator applications.

In the Atkey device, simultaneous movement of the telescoping members occurs in that in between each adjacent pair of telescopic cylinders, or cylinder and piston rod, a piston is attached to the lower end of the smaller member, and an annular seal is attached to the larger member, the seal receiving the smaller member in sliding, sealing relation. The apparatus is operated by pumping hydraulic fluid into the base cylinder below the innermost intermediate cylinder to force that cylinder upwardly. In normal operation, no fluid flows from the lower chamber, into which this fluid is pumped, into the upper chamber containing the intermediate cylinders and the piston rod. The telescoping arrangement of the upper components will result in their outward movement when the first intermediate cylinder is moved upwardly due to a change in the volume configuration of the upper components, that is, the reduction in volume between adjacent cylinders when the pistons are moved upwardly relative to the annular seal.

When applying the above-described telescoping cylinder apparatus to elevator applications, an annoying problem occurs. In the normal operation of the elevator, some leakage is expected at the region of the hydraulic seals between the telescoping cylinders. Such leakage causes the piston rod to settle toward the bottom of the apparatus. Also, after some leakage, the intermediate pistons upon extension will strike their upper limit points before the piston rod is fully extended, and thus the elevator may have trouble reaching the top floor. In practical operation, a passage is provided between the lower chamber and upper chamber and the piston rod will continue to extend upwardly as replacement fluid is forced through the passage, but only after a considerable jar. Also, a considerably higher pressure is required in that the piston rod has a much smaller transverse area upon which the fluid acts. In the opposite direction, when the cylinders are retracting back into the base cylinder, the piston rod will fully retract and strike the adjacent intermediate cylinder before the intermediate cylinders are fully retracted. Again it is true that the intermediate cylinder will continue to retract and lower the elevator to its lowest floor, but only after a considerable jarring of the elevator, and at a considerably reduced speed since the piston rod is not moving with respect to the intermediate cylinder. The problem in both cases results from a loss of hydraulic fluid in the annular chambers between each of the adjacent intermediate cylinders due to leakage.

SUMMARY OF THE INVENTION

The present invention is an improved telescopic hydraulic cylinder of the type described above which will automatically compensate for a loss of hydraulic fluid through the seals during the normal course of elevator operation. This is accomplished by providing a compensator pump which is actuated by the piston rod during the retraction phase of the elevator operation when a deficiency of fluid exists in the upper chamber, and which, under those conditions, transfers hydraulic fluid from the lower chamber to the upper chamber of the base cylinder.

More particularly, the telescopic hydraulic cylinder apparatus comprises a base cylinder closed at its lower end, at least one intermediate cylinder, and a piston rod extending outwardly from the upper end of the main cylinder. A piston is secured to the inner end of the inner most intermediate cylinder dividing the main cylinder into a lower chamber between the piston and the lower end of the main cylinder and an upper chamber between the piston and upper end of the main cylinder. A main hydraulic fluid pump is connected into the lower chamber to supply fluid under pressure. A compensator pump is also provided which selectively transfers fluid from the lower chamber to the upper chamber, the pump and piston rod arranged so that the piston rod selectively engages the pump at certain operating states of the apparatus. More particularly, the piston rod engages the pump when the apparatus is retracting and a deficiency of fluid exists in the upper chamber, and the pump thereafter acts to replenish the loss of hydraulic fluid in the upper cylinder.

The compensator pump includes a pump cylinder with an opening at its upper end, a pump piston rod disposed in the pump cylinder and extending through the opening in sliding, sealing engagement, and a pump piston attached to the piston rod at its lower end and slidably arranged within the cylinder in sealing engagement and so as to form an annular cavity between the pump piston rod and the pump cylinder when the rod is depressed into the cylinder. A spring is arranged within the pump cylinder for urging the pump piston toward the upper end of the cylinder.

In one form of the invention, the lower end of the pump cylinder communicates with the lower chamber of the base cylinder. The pump piston rod includes a duct which communicates with an opening in the bottom of the pump piston, the annular cavity through an opening in the pump piston rod adjacent the pump piston, and an opening in the pump piston rod near its upper end. When the pump piston rod is depressed by the piston rod, which will occur at operating state of the apparatus in which the upper chamber has lost hydraulic fluid, hydraulic fluid from the lower chamber flows into the annular cavity formed between the pump piston rod and the pump cylinder. When the piston rod is moved out of engagement with the pump piston rod, the spring forces the pump piston upwardly and the fluid contained in the annular recess into the upper chamber to replenish the lost fluid. Appropriate check valves are provided in the duct to prevent back flow of hydraulic fluid into the annular cavity or lower chamber.

In an alternative form of the invention, the pump cylinder has a duct formed therein which communicates between the lower chamber and the interior of the pump cylinder adjacent its upper end, that is, the annular cavity between the pump cylinder and the pump piston rod. A passage is provided in the pump piston communicating between the annular cavity and the lower part of the pump cylinder. Another fluid duct communicates between the interior of the pump cylinder near its lower end and the upper chamber. In this arrangement, when the piston rod depresses the pump piston, hydraulic fluid flows from the lower chamber into the annular chamber between the pump piston rod and the pump cylinder. At the same time, fluid contained in the lower part of the pump cylinder below the pump piston is forced through the second duct up into the upper chamber of the base cylinder. When the piston rod is moved out of engagement with the pump piston rod, the spring moves the pump piston upwardly, and hydraulic fluid in the pump chamber is forced out through the passage in the pump piston into the lower part of the pump cylinder to fill the volume created by the upward movement of the pump piston and replace the fluid previously pumped into the upper chamber. Appropriate check valves are provided within the pump piston duct and pump cylinder duct to prevent backward flow of the hydraulic fluid.

BRIEF DESCRIPTION OF THE DRAWINGS

For a better understanding of the present invention, reference is made to the accompanying drawings and Detailed Description, in which.

DETAILED DESCRIPTION

Figure 1:
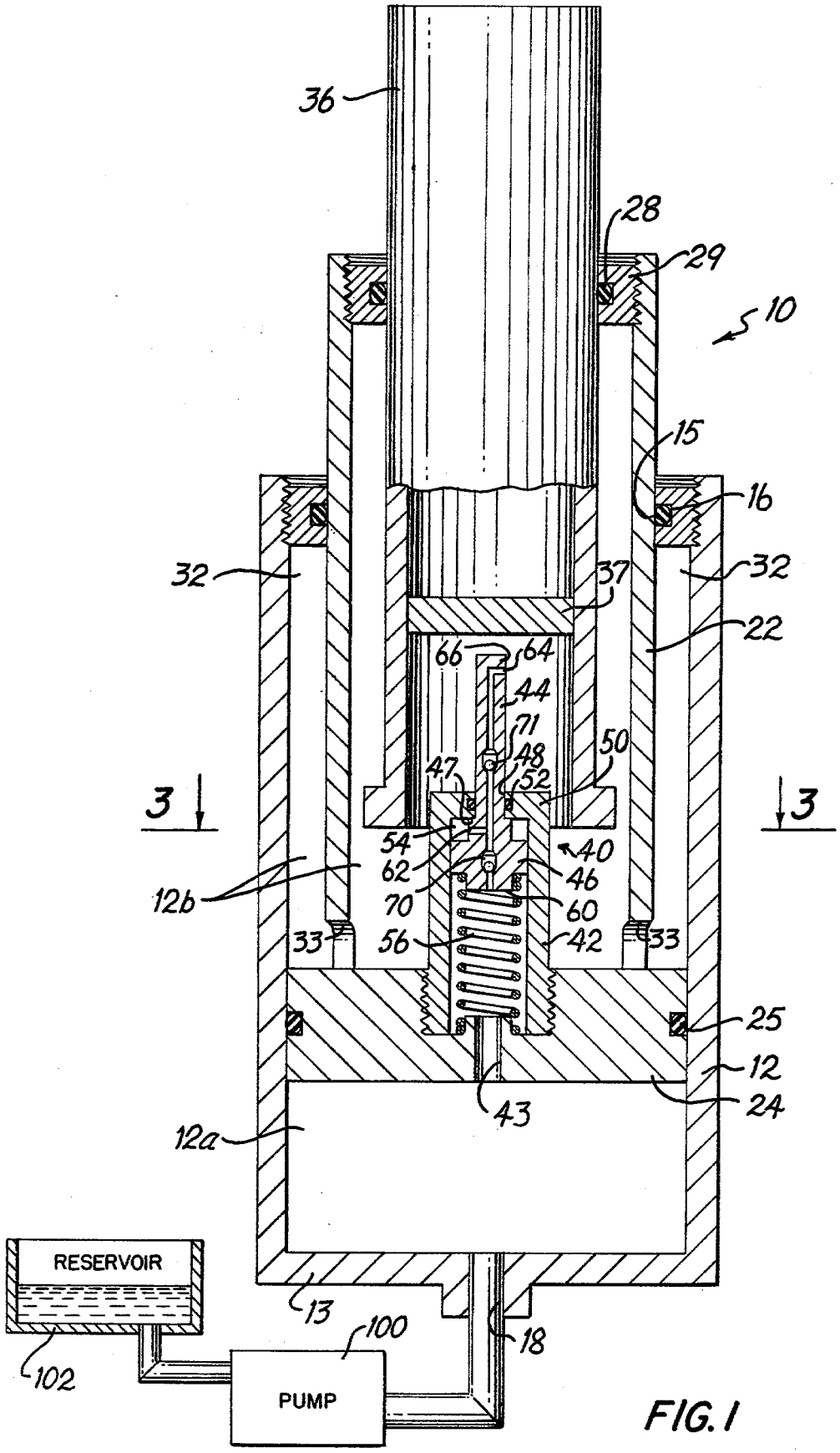
FIG. 1 is a longitudinal sectional view of a telescopic hydraulic cylinder apparatus according to the invention.
Figure 3:
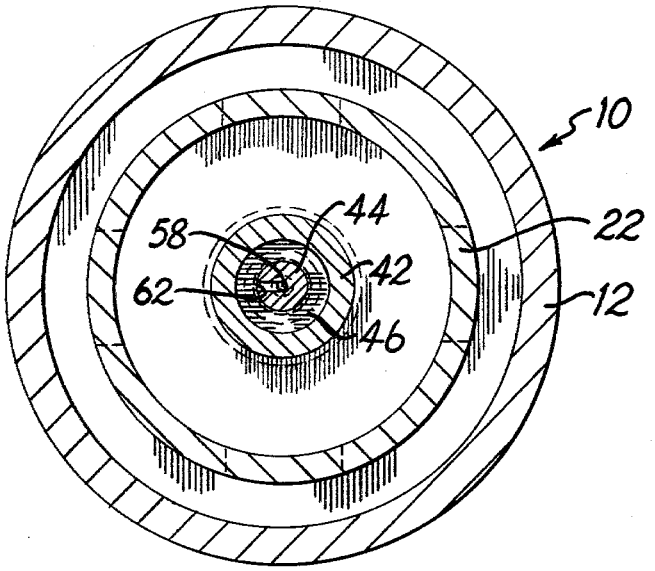
FIG. 3 is a cross section taken on line 3—3 of FIG. 1 in the direction of the arrows.

Referring to FIGS. 1 and 3 of the drawings, a hydraulic cylinder apparatus 10 includes a base cylinder 12 closed at its lower end 13 and having its upper end closed by a standard hydraulic seal 15 and bearing 16. A port 18 is provided in the bottom of the base cylinder 12 which connects to the main hydraulic pump 100 and reservoir 102.

An intermediate cylinder 22 is disposed within the base cylinder 12 and slidably extends through bearing 16 at the upper end of the base cylinder 12. The inner end of the intermediate cylinder 22 is closed by and connected to a piston 24 which is slidably mounted in base cylinder 12 and includes a hydraulic seal 25 between the piston 24 and the adjacent cylinder wall. The piston 24 divides the main cylinder 12 into a lower chamber 12*a* and an upper chamber 12*b*. The outer end of cylinder 22 is closed by a hydraulic seal 28 and bearing 29.

As the cross-sectional area of the intermediate cylinder 22 is less than that of base cylinder 12, an annular chamber 32 is formed between these cylinders. Suitable means is provided for maintaining the chamber 32 in communication with the interior of the cylinder 22, such as by one or more ports 33.

The apparatus 10 also includes a piston rod 36 disposed within the intermediate cylinder 22 and slidably extending through bearing 29 at the upper end of the intermediate cylinder 22. The cross section of this rod 36 is smaller than that of the intermediate cylinder 22 so that hydraulic fluid can move around the rod 36. It is preferable to provide the piston rod 36, if hollow, with a fixed stop 37 near its inner end, positioned as described below, to seal off the interior of the piston rod. The cylinders 12 and 22 are kept full of hydraulic fluid when the apparatus is ready for use.

A compensator pump 40 is provided for selectively transferring hydraulic fluid from the lower chamber 12*a* into the upper chamber 12*b*. The pump 40 includes a pump cylinder 42, a pump piston rod 44, and a pump piston 46. The pump cylinder 42 communicates at its lower end with the lower chamber 12*a* of the main cylinder 12 through a duct 43, and has an opening 48 in its upper end 50 which receives the pump piston rod 44. A seal 52 is contained in the opening 48 such that the pump piston rod 44 is received in sliding, sealing engagement. The pump piston 46 is attached to the lower end of the pump piston rod 44, and is disposed within the pump cylinder 42 in sliding, sealing engagement.

As arranged, an annular pump cavity 54 is formed between the pump piston rod 44 and pump cylinder 42 when the pump piston 46 and piston rod are depressed into the pump cylinder 42 against the force of spring 56. Optionally, a stop portion 47 is provided on the pump piston rod 44 to prevent the pump piston rod 44 from fully extending, and thus there will always be at least a small pump cavity 54 present. A duct 58 communicates between the lower side 60 of the pump piston 46 and the pump cavity 54 through an opening 62 in the pump piston rod 44 adjacent the pump piston 46, and between the pump cavity 54 and the upper chamber 12*b* through a second opening 64 in the pump piston rod 44 near its upper end 66. Back flow of fluid from the upper chamber 12*b* toward the pump cavity 54 or lower chamber 12*a*, or from the pump cavity 54 toward the lower chamber 12*a*, is prevented by a pair of check valves, one 70 placed in the duct 58 between the lower side 60 of the pump piston 46 and the opening 62, the other 71 disposed in the duct 58 between the opening 62 and the upper opening 64.

The operation of the hydraulic apparatus 10 and pump 40 will now be described. Fluid under pressure is directed from a reservoir 102 by a main pump 100 through port 18 into the base cylinder 12, forcing piston 24 and intermediate cylinder 22 to move upwardly relative to the base cylinder 12. As this happens, the volume of the annular chamber 32 between the base cylinder 12 and intermediate cylinder 22 decreases, and fluid from chamber 32 is forced into the interior of cylinder 22 through ports 33. The resultant pressure increase within the intermediate cylinder 22 pushes the piston rod 36 outwardly relative to the intermediate cylinder 22, so as to maintain the overall volume in the upper chamber 12*b* substantially constant. Thus, the cylinder 22 and piston rod 36 simultaneously move outwardly relative to the base cylinder 12 and piston rod 36 moves relative to the intermediate cylinder 22, and the intermediate cylinder 22 and piston rod 36 should reach the outermost limit of their stroke at the same time, assuming that there is sufficient hydraulic fluid in the upper chamber 12*b*. When the fluid is permitted to flow outwardly from the base cylinder 12 through port 18, the working load on rod 36 (i.e. the weight of the elevator car) causes the piston rod 36 and intermediate cylinder 22 to move downwardly and the telescoping apparatus to retract into the base cylinder 12, fluid transferring from within cylinder 22, through port 33, into chamber 32. The rod and intermediate cylinder simultaneously move relative to each other and to base cylinder 12.

When the piston rod 36 is under load, the fluid pressure in cylinder 22 is higher than the pressure in base cylinder 12 below piston 24 because of the reduced effective upper surface area of the piston 24 relative to its lower surface. Thus, any leakage past the piston will occur towards the lower end 13 of the base cylinder 12. If because of this or external leakage there is insufficient fluid trapped in cylinder 22 and chamber 32 to effect complete extension of rod 36, it is necessary to top up this fluid. In the present device, however, this occurs automatically. Where a deficiency of fluid exists, this device will provide additional fluid to the upper chamber 12*b* as the cylinders are extending, but the primary advantage of this apparatus occurs in that fluid deficiencies can be largely eliminated before the cylinders extend.

When the elevator is being lowered and the cylinders are retracting, a deficiency in fluid will cause the piston rod 36 to strike the piston 24 before the intermediate cylinder 22 is fully retracted. The pump 40 and piston rod 36 are arranged such that, before this occurs, the piston rod 36 depresses the pump piston 46 into the pump cylinder 42. Since there is still hydraulic fluid in the lower chamber 12*a*, and since the upper check valve prevents fluid back flow from the upper chamber 12*b*, some of the fluid contained in the lower chamber 12*a* will flow up through the duct 58 into the pump cavity 54 formed when the pump piston rod 44 is depressed. When the cylinder apparatus 10 is again actuated, and piston rod 36 moves out of engagement with the pump piston rod 44, the spring 56 forces the pump piston 46 upwardly. Thus, the fluid contained in the pump cavity 54, since the lower check valve 70 prevents back flow into the lower chamber 12*a*, is forced through the duct 58 into the upper chamber 12*b*.

Figure 2:
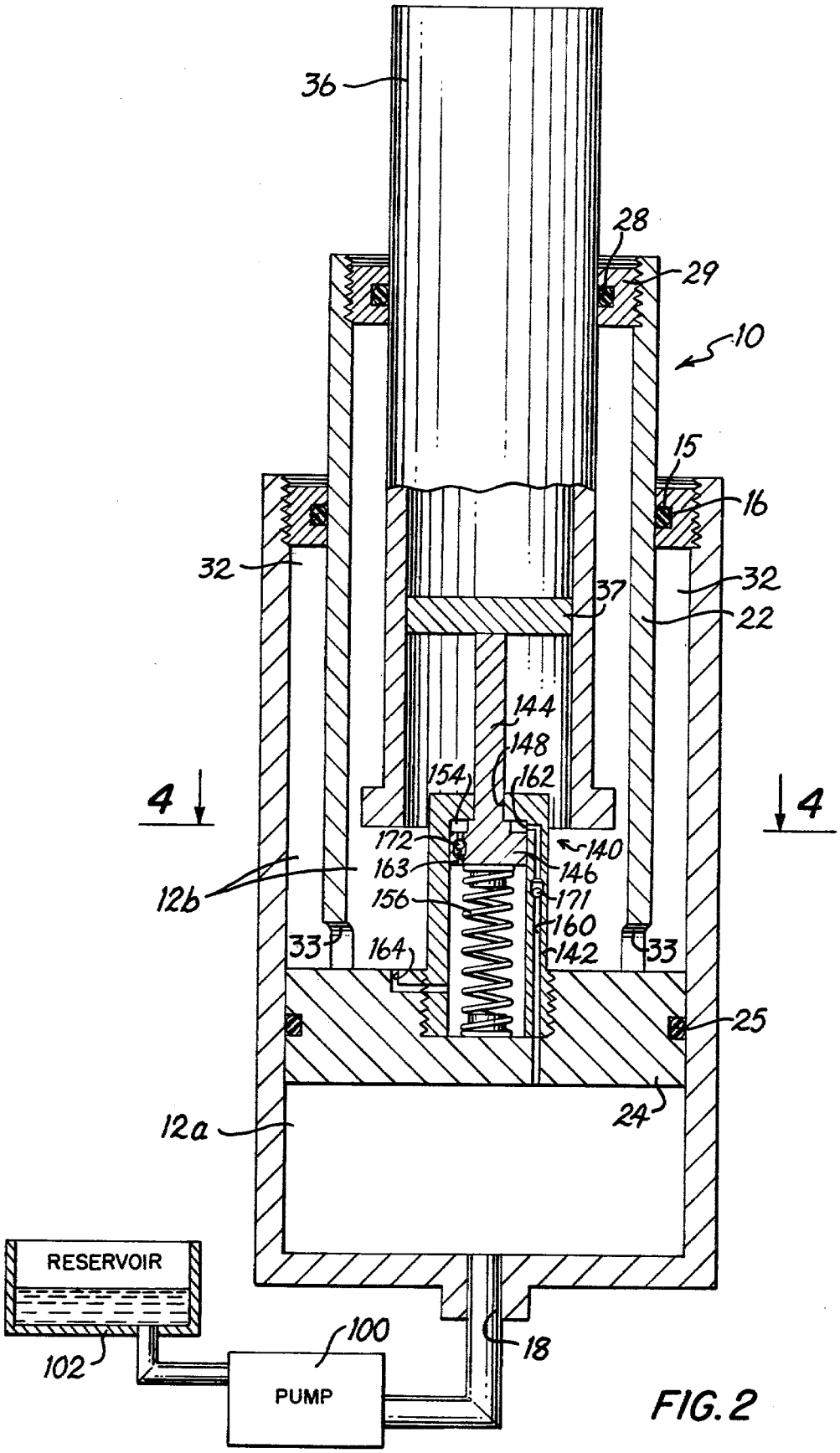
FIG. 2 is a longitudinal sectional view of a telescopic hydraulic cylinder apparatus, having a modified form of compensator pump, in accordance with the invention.
Figure 4:
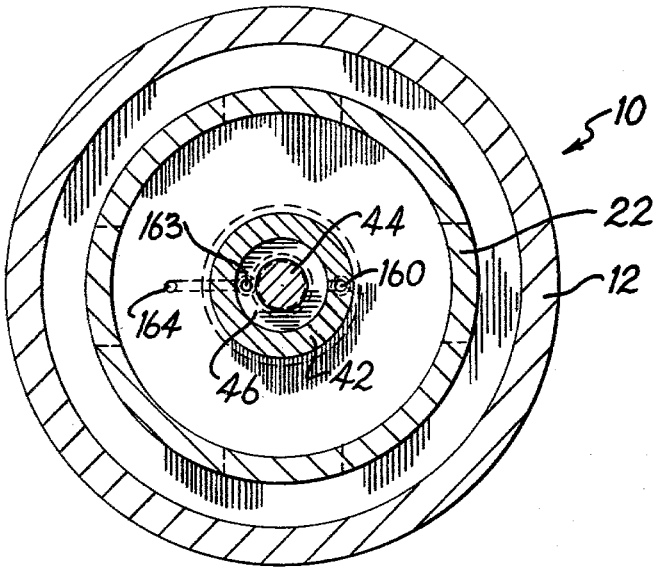
FIG. 4 is a cross section taken on line 4—4 of FIG. 2 in the direction of the arrows.

FIGS. 2 and 4 illustrate a telescopic type hydraulic cylinder apparatus 10 having an alternative form of compensator pump 140. The overall arrangement of the compensator pump 140, piston rod 36, main 12 and intermediate 22 cylinders is generally the same as the apparatus in FIG. 1. The pump 140 includes a pump cylinder 142 having an opening 148 at its upper end for receiving a pump piston rod 144 in sliding, sealing engagement. A pump piston 146 is attached to the pump piston rod 144 at its lower end and is disposed within the pump cylinder 142 in sliding, sealing engagement. As in the case of pump 40, an annular pump cavity 154 is formed between the pump piston rod 144 and the pump cylinder 142 when the pump piston rod 144 is depressed into the pump cylinder 142, as by engagement with the piston rod 36. One-way communication between the lower chamber 12*a* and the pump cavity 154 is provided by a duct 160, which terminates in an opening 162 near the upper end of the pump cylinder 142. A check valve 171 is disposed in the duct 160 to prevent back flow of fluid from the recess 154 into the lower chamber 12*a*. A passage 163 is also provided through the pump piston 146 between the pump cavity 154 and the lower part of the pump cylinder 142, and another one-way check valve 172 is interposed in the passage 163 to prevent upward flow back into the cavity 154. Finally, a duct 164 communicates between the lower part of the pump cylinder 142 and the upper chamber 12*b* of the main cylinder 12.

In operation, when the piston rod 36 and intermediate cylinder 22 are retracting, should a fluid deficiency exist, the piston rod 36 will strike the piston 24 before the cylinder 22 is fully retracted. Before piston 24 strikes cylinder 22, piston rod 36 will engage the pump 140 and depress the pump piston rod 144 into the pump cylinder 142. As this happens, the fluid in the lower part of the pump cylinder 142 is forced by the pump piston 146 through duct 164 into the upper chamber 12*b*. At the same time, some of the fluid still present in the lower chamber 12*a* will flow through the duct 160 and fill the annular cavity 154. When the cylinder apparatus is again actuated and the piston rod 36 moves out of engagement with the pump piston rod 144, a spring 156 forces the pump piston 146 upwardly and the fluid in the annular cavity 154 passes through the passage 163 into the lower part of the pump cylinder 142.

The amount of leakage that may be controlled by the compensator pumps 40 or 140 is, of course, limited by the capacity of the pumps and the frequency of the full retractions of the intermediate cylinder 122 and piston rod 36.

While the telescopic hydraulic clyinder apparatus has been described with reference to one intermediate cylinder, the invention may be used equally as well on a cylinder apparatus having more than one intermediate cylinder. Such a device is described and illustrated in Canadian Pat. No. 727,962 to Richard E. Atkey. In an apparatus having more than one intermediate cylinder, more than one fluid compensator pump would be preferred, each in turn pumping fluid into the next intermediate cylinder to compensate for loss of fluid from leakage. In such a case, the next smaller intermediate cylinder would serve the function of the piston rod 36, as described above, to actuate the compensator pump 40 or 140, and the use of the term piston rod will be so understood.

While the invention herein has been described with reference to specific embodiments thereof, it will be understood that variations and modifications will be apparent to those skilled in the art without departing from the inventive principles contained herein. All such modifications and variations are intended to be within the scope of the invention as contained in the following claims.

I claim:

1. In a telescopic hydraulic cylinder apparatus comprising a base cylinder closed at its lower end, at least one intermediate cylinder, and a piston rod extending outwardly from the upper end of said main cylinder, a piston secured to the inner end of the innermost intermediate cylinder dividing said main cylinder into a lower chamber between said piston and said lower end, and an upper chamber between said piston and said upper end, means for supplying hydraulic fluid under pressure into said lower chamber, and flow means for permitting fluid to flow in one direction only from said lower chamber into said upper chamber, the improvement wherein said flow means comprises a compensator pump means, said piston rod arranged so as to engage selectively said pump means at certain operating states of said apparatus, said pump means including means for permitting fluid to flow from said lower chamber into said pump means when said piston rod engages said pump means, and for pumping said fluid within said pump means into said upper chamber when said piston rod is moved out of engagement from said pump means.

2. Apparatus according to claim 1, wherein said compensator pump means comprises a pump cylinder with an opening at its upper end, a pump piston disposed within said pump cylinder in sliding, sealing engagement, a pump piston rod attached at its lower end to said pump piston, the upper end of said pump piston rod extending into said upper cavity through said opening in sliding, sealing engagement, wherein said pump piston rod and said pump cavity are sized such that an annular cavity is formed between said pump piston rod and said pump cylinder when said pump piston rod is depressed into said cylinder, and biasing means urging said piston toward said upper end away from the lower portion of said cylinder.

3. Apparatus according to claim 2, wherein said pump cylinder includes means communicating between said lower chamber and said lower portion of said pump cylinder, and wherein said pump piston rod includes duct means communicating between said lower portion and said annular cavity, and between said annular cavity and said upper chamber.

4. Apparatus according to claim 3, wherein said pump piston rod includes a first opening adjacent said pump piston, and a second opening near the upper end of said pump piston rod, said duct communicating with said openings, said apparatus further comprising a first check valve means disposed in said duct between the lower end of said pump piston and said first opening, and a second check valve means disposed in said duct between said first opening and said second opening, each said check valve means permitting flow in an upward direction only.

5. Apparatus according to claim 2, wherein said pump cylinder includes first duct means communicating between said lower chamber and an opening in said pump cylinder near the upper end of said pump cylinder, said pump piston includes a second duct means communicating between said annular cavity and said lower portion of said pump cylinder, and said pump cylinder and said piston include duct means communicating between said lower portion of said pump cylinder and said upper chamber.

6. Apparatus according to claim 5, further comprising a first check valve means disposed in said first duct means to permit fluid flow only toward said opening, and a second check valve means disposed in said second duct means to permit flow through said duct only out of said annular cavity.

* * * * *